United States Patent [19]

Yamazaki et al.

[11] Patent Number: 4,808,444

[45] Date of Patent: Feb. 28, 1989

[54] METHOD AND APPARATUS FOR COATING WEBS

[75] Inventors: Takeshi Yamazaki; Nobuyuki Yoshida; Yasuhiro Iizuka, all of Kanagawa, Japan

[73] Assignee: Fuji Photo Film Co., Ltd., Kanagawa, Japan

[21] Appl. No.: 99,854

[22] Filed: Sep. 22, 1987

[30] Foreign Application Priority Data

Sep. 22, 1986 [JP] Japan ..... 61-222208

[51] Int. Cl.[4] ..... B05D 1/26; B05D 1/30; B05D 1/34

[52] U.S. Cl. ..... 427/420; 118/412

[58] Field of Search ..... 118/247, 410, 411, DIG. 4, 118/412; 427/420

[56] References Cited

U.S. PATENT DOCUMENTS

| | | | |
|---|---|---|---|
| 2,873,719 | 2/1959 | Schubert | 118/247 |
| 3,220,877 | 11/1965 | Johnson | 117/120 |
| 3,885,518 | 5/1975 | Varni | 118/247 |
| 4,090,469 | 5/1978 | Roberts | 118/410 |
| 4,121,535 | 10/1978 | Roberts et al. | 118/410 |
| 4,233,346 | 11/1980 | Kerkhofs | 118/DIG. 4 |
| 4,277,301 | 7/1981 | McIntyre et al. | 118/247 |
| 4,339,481 | 7/1984 | Beekhuis | 118/247 |

FOREIGN PATENT DOCUMENTS

| | | | |
|---|---|---|---|
| 942522 | 2/1949 | France | 118/670 |
| 50-43140 | 4/1975 | Japan . | |
| 50-92328 | 7/1975 | Japan . | |
| 52-31727 | 3/1977 | Japan . | |
| 54-81347 | 6/1979 | Japan . | |
| 55-119470 | 9/1980 | Japan . | |
| 55-121865 | 9/1980 | Japan . | |
| 55-142565 | 11/1980 | Japan . | |
| 58-88074 | 3/1983 | Japan . | |
| 1120098 | 7/1968 | United Kingdom . | |

*Primary Examiner*—Shrive Beck

*Attorney, Agent, or Firm*—Sughrue, Mion, Zinn, Macpeak & Seas

[57] ABSTRACT

A coating method and apparatus in which a coating composition is applied from a hopper to a web continuously travelling on a backing roller. The backing roller is rapidly moved by a pneumatic mechanism relative to the hopper between positions at which the composition can and cannot be applied to the travelling web in order to avoid thick coating at a leading portion or at a spliced portion of the web.

4 Claims, 1 Drawing Sheet

METHOD AND APPARATUS FOR COATING WEBS

BACKGROUND OF THE INVENTION

1. Field of the Invention

The present invention relates to a bead coating method and apparatus for applying a coating composition to a continuously traveling web. It more particularly relates to a bead coating method and apparatus used for manufacturing photographic light-sensitive materials, recording materials, and the like.

2. Background of the Invention

Heretofore, bead coating methods and apparatus have been generally used for manufacturing photographic light-sensitive materials. Typical examples of the methods and apparatus are a slide hopper type bead coating method and apparatus, and an extrusion hopper type bead coating method and apparatus.

In those bead coating methods, a large quantity of coating composition must be supplied for forming beads at the start of coating. Hence, a thick coating portion is often generated. Further, the coating head must be moved away from the web when it is passed by a spliced portion of the web. Hence, bubbles are attached to the spliced portion so that a longitudinal strip occurs. Further, when the coating composition is applied, the thick coating portion is often generated. Various types of measures to eliminate the above defects have been proposed.

Examples of the measure to eliminate the generation of the thick coating portion include the following methods. One method improves the wetness of the coating composition, such as by roughing the web surface to be coated, by moistening the web surface, by applying corona discharge to the web surface, and the like.

Other methods improve the reduced pressure within a suction chamber for stabilizing coating beads. Reference is made to U.S. Pat. No. 3,220,877, Japanese Patent Unexamined Publication No. 92328/1975, Japanese Patent Unexamined Publication no. 31727/1977, Japanese Patent Publication No. 36025/1982, Japanese Patent Unexamined Publication No. 119470/1980, Japanese Patent Unexamined Publication No. 121865/1980, and Japanese Patent Unexamined Publication No. 142565/1980.

Examples of the measures to prevent the longitudinal stripe due to the attachment of bubbles to the spliced portion include the followings. One set of methods use improved splicing tapes for preventing the attachment of bubbles. Another set of methods apply hydrophobic liquid to the junction portion. Reference is made to Japanese Patent Publication No. 42725/1972, Japanese Patent Publication No. 4371/1973, Japanese Patent Unexamined Publication No. 40638/1975, Japanese Patent Unexamined Publication No. 43140/1975, Japanese Patent Unexamined Publication No. 34343/1979 and Japanese Patent Unexamined Publication No. 62241/1979. Recently, a method has been disclosed in which the coating head supporting the hopper is moved away from the backing roller when the spliced portion is passed through the coating bead portion. Reference is made to Japanese Patent Unexamined Publication No. 88074/1983.

In any one of the conventional coating methods, the coating head supporting the hopper must be moved relative to the backing roller supporting the travelling web in order to approach the web or to retreat from the web.

The coating head is constituted by a hopper and a pedestal for supporting the hopper. The hopper must be formed of a specific alloy having a small coefficient of thermal expansion in order to maintain accuracy so that the hopper becomes considerably large in volume and heavy in weight. Further, the pedestal supporting the hopper must be protected against vibration from the outside so that the pedestal becomes considerable heavy in weight. Accordingly, in the case where such heavy weight elements are rapidly moved at the start of coating or at the time of being passed by the spliced portion, a limit exists for both the distance and speed because of inertia. Accordingly, there is a limit in the minimum coating quantity for a coating process. Further, the time required for supplying the coating composition at a process of coating becomes long. Consequently, there is a limit in preventing a thick coating at the start of coating and preventing bubble attachment and thick coating at the time of being passed by the spliced portion. Thus, the loss of length in the products cannot be disregarded.

SUMMARY OF THE INVENTION

It is therefore an object of the present invention to provide a coating method and apparatus which reliably applies a coating composition at the start of coating both to prevent thick composition at a portion to be coated and to reduce the loss of the thus manufactured products due to longitudinal stripe and thick coating at the time of being passed by the spliced portion.

To solve the aforementioned problems, the inventors of this application concentrated on increasing the speed at which the coating head comes into contact with and separates from the travelling web.

The subject of the present invention involves the mechanism in which the backing roller supporting the travelling web is moved so as to approach or separate from the coating head supporting the hopper, whereas, in the prior art, the coating head is moved to approach to or separate from the backing roller.

In order to attain the above object, according to a first aspect of the present invention, the coating method for applying a beaded coating composition form a hopper to a web continuously travelling around a backing roller, comprises the steps of bringing the hopper close to the web to minimize the distance between the hopper and the web within a range in which the coating composition from the hopper is not applied to the web and then moving the backing roller rapidly close to the hopper to make it possible to apply the coating composition to the travelling web.

According to a second aspect of the present invention, the coating method for applying a beaded coating composition from a hopper to a web continuously travelling around a backing roller, comprises the steps of moving the backing roller rapidly away from the hopper to form the shortest distance between the hopper and the web within the range in which the coating composition from the hopper is not applied to the web when a spliced portion of the web is passed through the beaded coating composition and then rapidly moving the backing roller close to the hopper to make it possible to apply the coating composition to the web after the spliced portion of the web has passed through the beaded coating composition.

According to a third aspect of the present invention, the coating apparatus for applying a beaded coating composition from a hopper to a web continuously travelling around a backing roller comprises means for moving the backing roller rapidly close to the hopper and for moving the backing roller rapidly away from the hopper.

The hopper is formed of a specific alloy so that slots of the hopper for forming liquid film cannot be distorted by heat and that the intervals between the slots cannot be changed. Accordingly, the hopper is considerably large in volume and heavy in weight. Further, the pedestal for support in the hopper is so large in volume and heavy in weight as to be protected against vibration.

As the hopper must be removed when cleaned or adjusted, it is necessary that the coating head for supporting the hopper has an included moving mechanism.

However, it is impossible that the coating hopper is moved relative to the backing roller speedily enough to prevent coating irregularity, because piping vibration or coating film disorder occurs due to the movement of the hopper.

Accordingly to the present invention, the moving means provided on the side of the backing roller for the purpose of distance adjustment can have sufficiently light weight compared to that of the coating head. Accordingly, the moved distance can be relatively remarkably reduced and the moving speed can be greatly increased, compared to those in the case where the coating head is moved.

DETAILED DESCRIPTION OF THE PREFERRED EMBODIMENTS

Figure 1:
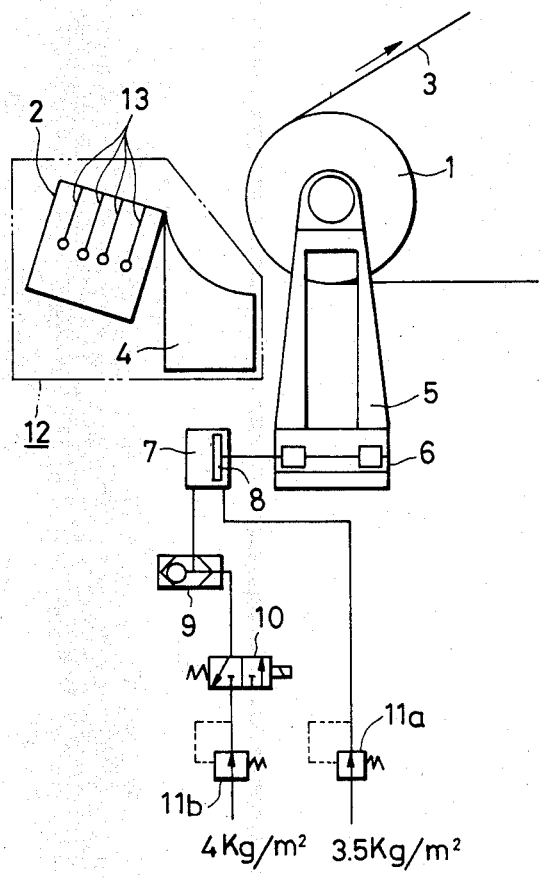
FIG. 1 is a side view showing an embodiment of the means for moving the backing roller to rapidly approach to and to rapidly separate from the hopper according to the present invention, and showing the state in which the coating head is separated from the backing roller.

Referring now to FIG. 1, a coating head 12 is moved away from a backing roller 1 by an unillustrated mechanism for moving the coating head when a hopper is cleaned or adjusted before the coating operation.

The coating head 12 is constituted by a slide hopper 2, a suction chamber 4, a pedestal for supporting the slide hopper 2, the suction chamber 4, and the like. The suction chamber 4 is used as a pressure-reducing means for preventing air from being entrapped between the bead portion and the web in the process of coating. Including the suction chamber 4 and the like, the coating head 12 has a very heavy weight. Accordingly, the moving speed of the coating head is selected to be from 2 to 10 mm/sec.

An air cylinder 7 is provided as an example of means for moving the backing roller 1 supporting the travelling web 3 to rapidly approach to and separate from the coating head 12. A stand 5 supporting the backing roller 1 is moved along a slide rail 6 by the air cylinder 7. A piston 8 of the air cylinder 7 is pressed in the direction of retraction by compressed air (for example, at 3.5 kg/cm$^2$) from a pressure-reducing valve 11a acting in the approaching direction and more highly compressed air (for example 4 kg/cm$^2$) from a pressure-reducing valve **11*b* acting in the retraction direction. Assuming now that an electromagnetic valve 10 is switched to close the more highly compressed air, the backing roller 1 is rapidly moved to approach to the hopper 2 by the air exhausted from a rapid exhaust valve 9. Assuming that the electromagnetic valve 10 is switched to open the compressed air at 4 kg/cm$^2$, the piston 8 is pressed back to the right against the air pressure of 3.5 kg/cm2 so that the backing roller 1** is rapidly moved away from the slide hopper.

The backing roller 1 can be rapidly operated by use of air pressure without having to be operated by use of oil pressure, because the backing roller 1 is relatively light compared to the coating head 12. The moving speed is made high to be within the range of from 30 to 120 mm/sec. That is, the moving speed can be increased by about 10 times that of the conventional coating head.

Figure 2:
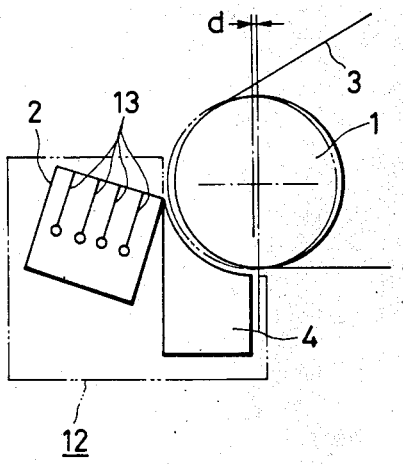
FIG. 2 is a side view for explaining the positional relation of the hopper and the backing roller in each point of time when the coating operation starts, when the coating operation is continued and when the coating head is passed by the spliced portion.

According to the present invention, the hopper is initially brought into a position at a minimum distance between the hopper 2 and the web 3. This minimum distance is the minimum within the range in which the coating composition from the hopper 2 cannot be applied to the web 3. Then, when the coating composition is to be applied or the spliced portion is to be passed, the backing roller 1 is rapidly moved close to or away from the hopper between the position at the above-mentioned minimum distance and a position at a distance where the coating composition can be applied to the travelling web. This operation of the present invention will be described hereunder with reference to FIG. 2.

At the start of coating, the coating head is moved to its standby position, so that the clearance between the slide hopper 2 and the backing roller 1 supporting the web 3 is established to be from 0.5 to 2.2 mm. In other words, the hopper is brought close to the web to minimize the distance between the hopper and the web within the range in which the coating composition from the hopper is not applied to the web. After the lapse of a standby time of from 2 to 4 sec, the backing roller 1 is rapidly moved to the left by the rapid pneumatic moving means by a distance d toward the coating composition which flows out of the slots 13 of the slide hopper 2. As a result, the clearance is reduced to a range from 0.2 to 0.4 mm in which the coating composition can be applied to the web. Thus, beads are formed between the hopper 2 and the web 3. Generally, it is preferable that the distance d is selected to be about from 0.5 to 2 mm.

In the clearance in the standby state, the suction chamber 4 can be subject to back suction pressure from before the application, which pressure is 10% to 50% compared to that in the application state. Accordingly, the back suction pressure is changed to a predetermined value soon when the backing roller 1 is rapidly moved close to the hopper. Thus, the beads in the application state can be formed stably and speedily.

Further, in the application state, the slide hopper 2 does not move but only the backing roller 1 moves. Accordingly, there is no coating irregularity caused by piping vibration as well as by liquid disorder on the slide plane. Further, in the application state, the moving speed is so high that coating irregularity such as a longitudinal stripe, a reverse U-shaped top irregularity and the like, can scarcely occur. Accordingly, there occurs no thick coating. Accordingly, it is unnecessary to increase the coating quantity particularly in the application state. Thus, coating at a low flow rate can be performed.

Further, in the state of passage of the spliced portion, the backing roller 1 is rapidly moved back by the distance d by the rapid moving means of the backing roller 1 to widen the distance between the hopper and the travelling web, whereafter the backing roller 1 is promptly returned. The motion of the backing roller 1 is so rapid that the beads cannot be broken in the time of being passed by the spliced portion. Accordingly, coating can be continued without occurrence of thick coating. Consequently, the loss of products can be remarkably reduced.

Examples of the web to be used according to the present invention include a paper web, a resin film web, a resin coated paper web, a synthetic paper web and the like. Examples of resin materials used in the resin film web are polyolefins, such as polyethylene, polypropylene and the like; vinyl copolymers, such as polyvinyl acetate, polyvinyl chloride, polystyrene, and the like; polyamides, such as 6,6-Nylon, 6-Nylon and the like; polyesters, such as polyethylene terephthalate, polythylene-2, 6-naphthalate, and the like; polycarbonates; cellulose acetates, such as cellulose triacetate, celluose diacetate and the like; and other similar materials. Examples of resin materials used in the resin-coated paper web are polyolefins, such as polyethyelene and the like, but the resin materials are not limited thereto. A typical example of the metal web is an aluminum web.

Examples of the coating composition to be used according to the present invention include various types of liquid compounds which contain binders formed of natural or synthetic organic macromolecules, such as gelatin, polyvinyl alcohol, styrenemaleic anhydride copolymers and the like, and which have viscoelasticity with appropriate bead coating characteristics. Typical examples are silver halide emulsion coating compositions, back layer coating compositions and protective layer coating compositions employed for manufacturing photographic light-sensitive materials.

The hopper to be used according to the present invention may be a slide hopper, and extrusion hopper, a slide-extrusion combination hopper type and the like. The coating film formed by the hopper may be a monolayer or may have multiple layers.

EXAMPLE

A backing roller, as shown in FIG. 1, was provided with means for moving the backing roller to approach to and separate from a coating head to thereby prepare a coating apparatus of the present invention. A four-layer film was applied to color photographic paper at a coating speed of 30 m/min by use of slide hopper 2 capable of applying four layers at the same time. Before application, the coating head was moved close to the backing roller to establish the shortest distance between the hopper and the travelling web within the range in which the coating composition flowing out of the slots 13 of the hopper 2 to form the film cannot be applied to the web. After the procedure, the coating composition was applied to the web by use of the means for moving the backing roller close to or away from the coating head. The resulting condition of the example was estimated as shown in Table 1, compared to that of a comparative example in which a conventional coating head was moved close to the backing roller 1.

TABLE 1

| Coating quantity | Comparative Example | Example (Invention) |
|---|---|---|
| 100% | Occurrence of drying trouble due to thick coating. | Uniform coating No thick coating. |
| 80% | Slight occurrence of drying difficulty due to thick coating. | The same as above |
| 60% | No occurrence of drying difficulty, but existence of thick coating. | The same as above |
| 40% | Difficulty of application due to low flow rate. | The same as above |

In the prior art method, when the coating quantity is 100%, drying difficulty occurs due to the thick coating portion in the process of coating. It is apparent from this point that the coating quantity must be reduced in order to prevent such drying trouble. Further, the prior art method has the disadvantage that the coating cannot be applied when the coating quantity is small or in other words when the flow rate is low. It is, however, apparent from Table 1 that the example according to the present invention has the advantage that the capability of drying can be efficiently used without forming thick coating in the coating process even when the coating quantity is 100%. Further, thin layer coating can be made even when the coating quantity is 40%.

The amount of deviation in the coating quantity applied to the web was measured at a certain distance from the initial line. In the prior art method, the amount of deviation was 7% at a distance up to 0.5 m, 3% at a distance from 0.5 m to 1.1 m, and not more than 2% at a distance over 1.1 m. In the example according to the present invention, the amount of deviation was 3% at a distance up to 0.2 m, and not more than 2% at a distance over 0.2 m.

It is apparent from the results that the example according to the present invention has the advantage that the amount of deviation is small enough to attain uniform coating.

Further, as the result that the minimum quantity to make coating possible was measured, the prior art method experienced the occurrence of reverse U-shaped irregularity at a coating density of 48 cc/m$^2$, whereas the present invention had no trouble such as thick coating trouble at coatings up to 24 cc/m$^2$.

As described above, according to the invention, the hopper is initially brought into a position at a minimum distance between the hopper and the web at which the coating composition from the hopper cannot be applied to the web. Then, when the coating composition is to be applied or the spliced portion is to pass, the backing roller is rapidly moved close to or away from the hopper between the postion at the above-mentioned minimum distance and a position at a distance where the coating composition can be applied to the web. Accordingly, the present invention greatly contributes to the improvement of the manufacturing efficiency. Further, uniform surface quality can be attained so that the coated product according to the present invention can be soon used as a finished one.

Further, continuous coating can be made without any trouble when the spliced portion passes the coating point. Accordingly, it is possible to cope with an abnormal state speedily in the process of coating. Accordingly, the yield of products can be improved.

Accordingly, thin-layer coatings are possible efficiently with good yield. This contributes to improvement of manufacturing efficiency, improvement of product quality and reduction of cost.

What is claimed is:

1. A coating method for applying coating composition from a relatively heavy hopper having attendantly high inertia to a web continuously travelling around a relatively light backing roller and translatable therewith, said backing roller having attendantly low inertia, said method comprising the steps of;

bringing said relatively heavy hopper close to said web at a first speed to minimize a distance between said hopper and said web within a range in which said coating composition from said hopper is not applied to said web; and thereafter moving said relatively light backing roller close to said hopper at a second speed greater than said first speed to apply said coating composition to said web.

2. The coating method according to claim 1, further comprising the steps of:

moving said relatively light backing roller away from said hopper at said second speed to minimize the distance between said hopper and said web within a range in which said coating composition from said hopper is not applied to said web when a spliced portion of said web passes through said beaded coating composition; and thereafter moving said backing roller close to said hopper at said second speed to apply said coating composition to said web after said spliced portion of said web has passed through said beaded coating composition.

3. A coating apparatus, comprising:

a relatively heavy hopper having attendantly high inertia;

a relatively light backing roller having attendantly low inertia around which a web continuously travels, said web being translatable with a translation of said backing roller;

means for applying a coating composition from said relatively heavy hopper to said web;

means for moving said relatively heavy hopper close to said web at a first speed to minimize the distance between said hopper and said web within the range in which said coating composition from said hopper is not applied to said web; and second means for moving said relatively light backing roller, and thus said web, close to said hopper at a second speed faster than said first speed and for moving said backing roller, and thus said web, away from said hopper at said second speed.

4. A coating apparatus as recited in claim 3, wherein said second moving means are pneumatic means operatively connected to said backing roller.

* * * * *